US011746577B2

(12) United States Patent
Chen et al.

(10) Patent No.: US 11,746,577 B2
(45) Date of Patent: Sep. 5, 2023

(54) UNLOCKING AND LOCKING METHOD OF CABINET LOCK AND CABINET SAFETY LOCK

(71) Applicant: Ningbo Eudemon Child Protective Equipment Co., Ltd., Zhejiang (CN)

(72) Inventors: Yingfeng Chen, Zhejiang (CN); Zhen Zhang, Zhejiang (CN)

(73) Assignee: Ningbo Eudemon Child Protective Equipment Co., Ltd., Ningbo (CN)

( * ) Notice: Subject to any disclaimer, the term of this patent is extended or adjusted under 35 U.S.C. 154(b) by 144 days.

(21) Appl. No.: 17/168,798

(22) Filed: Feb. 5, 2021

(65) Prior Publication Data

US 2022/0205292 A1 Jun. 30, 2022

(30) Foreign Application Priority Data

Dec. 30, 2020 (CN) ..... 202011606196.0

(51) Int. Cl.
*E05C 3/16* (2006.01)
*E05B 65/00* (2006.01)
(Continued)

(52) U.S. Cl.
CPC ..... *E05C 3/162* (2013.01); *E05B 65/0014* (2013.01); *E05C 3/22* (2013.01);
(Continued)

(58) Field of Classification Search
CPC ... Y10T 292/08; Y10T 292/82; Y10T 292/85; Y10T 292/0908; Y10T 292/0863; Y10T 292/0864; Y10T 292/20; Y10T 292/228; Y10T 292/34; Y10T 292/37; Y10T 292/373; Y10T 292/65; E05C 3/162; E05C 3/22; E05C 5/00; E05C 5/02; E05C 19/003; E05C 19/18; E05C 19/184; E05C 19/188; E05B 65/0014; E05B 1/00; E05B 1/0007;
(Continued)

(56) References Cited

U.S. PATENT DOCUMENTS 798,583 A * 8/1905 Harris ..... E05C 1/04 292/205
874,712 A * 12/1907 Tyden ..... E05B 65/0864 292/57
(Continued)

FOREIGN PATENT DOCUMENTS

CN 111894365 A * 11/2020 ..... E05B 15/00
DE 102007057153 A1 * 6/2009 ..... E05C 17/46
(Continued)

*Primary Examiner* — Kristina R Fulton
*Assistant Examiner* — Steven A Tullia

(57) ABSTRACT

The invention belongs to the technical field of daily necessities, and particularly relates to an unlocking and locking method of a cabinet lock and a cabinet safety lock. During unlocking, a lock rod is displaced relative to a locking assembly to release the locking of the lock rod, and a first lock rod is rotated to an unlocked position. During locking, the first lock rod is rotated to a locked position and the locking assembly is engaged with the lock rod to lock the second lock rod. The method and the cabinet safety lock have a novel operating mode, have a firm structure, are convenient to use, and can effectively avoid unauthorized operation by children.

10 Claims, 5 Drawing Sheets

(51) Int. Cl.

| | |
|---|---|
| ***E05C 3/22*** | (2006.01) |
| ***E05B 17/20*** | (2006.01) |
| ***E05C 5/02*** | (2006.01) |
| ***E05C 17/04*** | (2006.01) |

(52) U.S. Cl.
CPC ..... *E05B 17/20* (2013.01); *E05C 5/02* (2013.01); *E05C 17/04* (2013.01)

(58) Field of Classification Search
CPC ..... E05B 1/0069; E05B 65/10; E05B 65/106; E05B 65/1066; E05B 65/0035; E05B 65/44; E05B 65/46; E05B 17/20; E05B 17/2007; E05B 17/2015; E05B 17/203; E05B 17/2038; E05B 17/00; E05B 17/02; E05B 17/04; E05B 17/047; E05B 17/12; E05B 17/22; E05B 17/44; E05B 17/446; E05B 17/46; E05B 17/48; E05B 17/50; E05B 1/0038; E05B 13/105; E05B 37/0068; E05B 67/22; A47B 88/50; A47B 88/57
See application file for complete search history.

(56) References Cited

U.S. PATENT DOCUMENTS 1,530,671 A * 3/1925 Hoffman ..... E05C 17/04 70/144
2,924,476 A * 2/1960 Deane ..... E05C 19/18 292/288
4,275,910 A * 6/1981 Budish ..... E05C 1/04 49/67
4,702,095 A * 10/1987 Ben-Asher ..... E05B 47/023 292/201
4,833,737 A * 5/1989 Boucher ..... A47K 13/242 292/266
4,854,448 A * 8/1989 Hair, II ..... E05B 65/0014 220/326
4,921,287 A * 5/1990 Horvath ..... E05C 17/14 292/DIG. 60
5,114,193 A * 5/1992 Nass ..... E05C 3/047 292/67
5,265,921 A * 11/1993 Nikitas ..... E05C 19/18 292/DIG. 28
5,388,876 A * 2/1995 Saincome ..... F25D 29/006 292/288
8,100,443 B2 * 1/2012 Talpe ..... A47K 13/242 292/266
9,702,172 B2 * 7/2017 Su ..... E05C 17/14 292/DIG. 60
2006/0076787 A1 * 4/2006 Sundberg ..... E05B 65/0014 292/336.3
2006/0185253 A1 * 8/2006 Marsden ..... E05B 65/0864 292/57
2008/0209962 A1 * 9/2008 Peot ..... E05C 19/18 292/288
2010/0264675 A1 * 10/2010 Varney ..... E05C 3/047 292/67
2016/0128476 A1 * 5/2016 Ng ..... F25D 29/006 292/288

FOREIGN PATENT DOCUMENTS

EP 1310627 A1 * 5/2003 ..... E05C 17/04
FR 2682307 A1 * 4/1993 ..... E05C 17/025
FR 2842559 A1 * 1/2004 ..... E05C 17/50
JP 3438184 B2 * 12/1999 ..... B65D 19/12
KR 200351102 Y1 * 4/2003 ..... E05C 17/04
WO WO-0107739 A1 * 2/2001 ..... E05B 17/005

* cited by examiner

UNLOCKING AND LOCKING METHOD OF CABINET LOCK AND CABINET SAFETY LOCK

FIELD OF THE INVENTION

The invention belongs to the technical field of daily necessities, and particularly relates to an unlocking and locking method of a cabinet lock for locking furniture such as cabinets and drawers to prevent unauthorized opening by children, and a cabinet safety lock.

BACKGROUND OF THE INVENTION

As household products commonly used by people nowadays, cabinets bring convenience to people's lives, but also cause some safety problems, mainly including cleaning troubles and potential safety hazards resulting from unauthorized opening by children. Especially with the promotion of urbanization, more and more children are growing up in high-rise buildings. After one year old, children basically have the initial moving ability with the strongest curiosity, like new things and are willing to explore; therefore, they are very likely to open doors or drawers of cabinets when playing. On the one hand, this may mess up the items that were originally stored and organized. More seriously, it may even cause potential safety hazards. For example, the items in the cabinets are not safe for children, or the corners may hurt children after the cabinets are opened.

Therefore, it is necessary to develop an unlocking and locking method of a cabinet lock which is safer and less likely to be opened by children without authorization, and a novel cabinet safety lock.

SUMMARY OF THE INVENTION

An object of the invention is to provide an unlocking and locking method of a cabinet lock which has a novel locking mode and can avoid operation by children, and a cabinet safety lock.

In a first aspect of the invention, an unlocking and locking method of a cabinet lock is provided.

During an unlocking operation, a force is applied so that the lock rod has a relative displacement in an X-axis direction with respect to the locking assembly and thus the state where the lock rod can rotate around the X-axis direction is transitioned from a locked state to a rotatable state; and the first lock rod is rotated from a locked position to an unlocked position to realize the unlocking operation. During the locking operation, the lock rod is placed in a rotatable state and the first lock rod is rotated from the unlocked position to the locked position; and the locking assembly and the lock rod are displaced relative to each other in opposite directions, so that the rotation of the second lock rod around the X-axis direction is locked, thus locking the cabinet.

According to the above method, it is preferable that the lock rod is fixed in the X-axis direction, and the locking assembly is close to or away from the lock rod in the X-axis direction, thus locking or unlocking the lock rod.

According to any method described above, a pre-unlocking member is also arranged on a displacement path of a locking member to limit the position of the locking member. During unlocking, the pre-unlocking member must be operated to release the above locking and then the locking member can be operated for unlocking, thereby improving the safety of the method and avoiding unauthorized operation by children.

According to any method described above, the lock body is also internally provided with an auxiliary unlocking member for holding the locking member in an unlocked state, thereby simplifying the locking operation; and, after the locking operation is completed, the components can be automatically reset under the action of return springs. This can not only ensure the safety of the method and avoid misoperation by children, but also reduce the overall complexity of the operation and improve the user experience.

In a second aspect of the invention, there is provided a cabinet safety lock including a lock body, a lock rod and a locking assembly. When the lock rod is rotated to different angles around the X axis as an axis, the first lock rod is at different positions, so that the first lock rod is formed in a locked or unlocked state; and the first lock rod prevents the opening of a door, a drawer, etc. in a locked state, but has no limiting effect in an unlocked state.

The cabinet safety lock can be used to implement any method described above, and can be separately implemented independently of the above method.

The method and the cabinet safety lock have a novel operating mode, have a firm structure and are convenient to use. In a preferred embodiment, the unlocking operation requires separate operation of the pre-unlocking member and the locking member, which can effectively prevent unauthorized opening by children; but the locking operation only requires rotation of the lock rod without other operations, which can simplify the operation and improve the user experience.

DETAILED DESCRIPTION OF THE INVENTION

Figure 1:
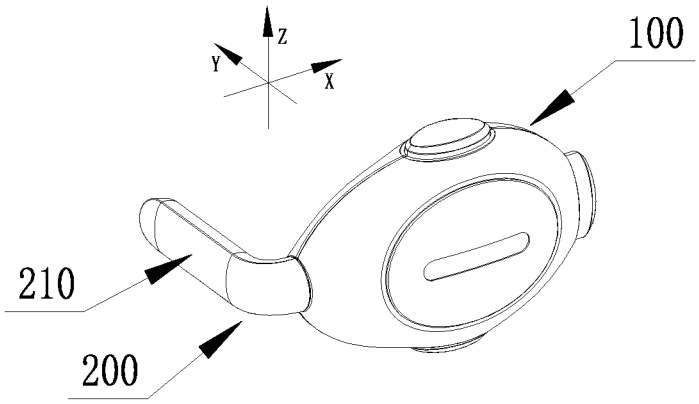
FIG. 1 is a three-dimensional schematic structural view of a cabinet safety lock in a locked state according to an embodiment of the invention; wherein X-, Y- and Z-axis directions are defined, based on which the following description will be made.

In order to more clearly define the protection scope of the invention to enable those skilled in the art to better understand the invention, the invention will be described in detail below with regard to some particular embodiments of the invention. It should be noted that the following involves only some particular embodiments of the inventive concept and only a part of the embodiments of the invention, wherein the specific and direct descriptions of related structures are only for the convenience of understanding the invention, and various specific features are not of course and directly limit the implementation scope of the invention. Conventional selection and replacement made by those skilled in the art under the guidance of the inventive concept should be regarded as falling within the protection scope claimed by the invention.

An unlocking and locking method of a cabinet lock includes unlocking and locking operations.

To facilitate the subsequent description, firstly, a reference coordinate system is defined; and the three mutually perpendicular X-, Y- and Z-axis directions of a three-dimensional coordinate system are defined, a base 101 of the cabinet lock is fixed along the YX plane, and a lock rod 200 of the cabinet lock is rotatably arranged on a lock body 100 around the X-axis direction as an axis.

The cabinet lock includes a lock body 100 for fixed connection with a cabinet, and a lock rod 200 movably arranged on the lock body 100, wherein different fitting states of the lock rod 200 on the lock body 100 form a locked state where a door or drawer of the cabinet can be locked, and an unlocked state where the door or drawer of the cabinet can be normally opened or closed for use.

The unlocking operation includes the following steps:

Firstly, a force is applied to the lock rod 200 or a locking assembly 300 so that the lock rod 200 has a relative displacement in an X-axis direction with respect to the locking assembly 300, wherein the relative displacement may be relatively close or far away to transition the lock rod 200 from a locked state to a rotatable state.

The relative displacement of the lock rod 200 with respect to the locking assembly 300 in the X-axis direction may be that the lock rod 200 is fixed in the X-axis direction and the locking assembly 300 can be arranged to translate leftward or rightward in the X-axis direction, or that the locking assembly 300 is fixed in the X-axis direction and the lock rod 200 can be arranged to translate leftward or rightward in the X-axis direction, or that both can be arranged to displace leftward or rightward in the X-axis direction.

The locked state refers to a state where the rotation of the lock rod 200 around the X-axis direction as an axis is locked and the lock rod cannot be rotated, and the unlocked state refers to a state which the above locking is released so that the lock rod 200 returns to be rotatable around the X-axis direction as an axis to allow a first lock rod 210 to rotate to different angles (i.e. different positions); and the position of the first lock rod 210 in the locked state is a locked position, while its position in the unlocked state is an unlocked position. Moreover, in principle, the above locked and unlocked positions may be either definite angular positions or regions, both of which can achieve the purpose of locking or unlocking. From the perspective of actual use, the locked and unlocked positions are preferably fixed angular positions, especially for the locked position, a fixed angular position is most preferred.

For this reason, a second lock rod 220 of the lock rod 200 is arranged in the X-axis direction, so that the lock rod 200 is rotatably arranged around the center line of the second lock rod 220 as an axis; and the first lock rod 210 and the second lock rod 220 of the lock rod 200 are arranged at an included angle, for example, at an angle of 90° or close to 90° to form an L-shaped or approximately L-shaped lock rod 200, so that the first lock rod 210 is rotated to different positions around the second lock rod 220 to form different states, thus locking or unlocking the cabinet.

A first end of the first lock rod 210 is formed as a locking end of the lock rod 200, a second end of the first lock rod 210 is connected to or integrally formed with a first end of the second lock rod 220, and a second end of the second lock rod 220 is used to cooperate with the locking assembly 300, so that the lock rod 200 is switched between a rotatable state and a rotation-locked state as a whole by the relative displacement (relatively close or far away) therebetween.

The principle of the first lock rod 210 to lock the cabinet is that the first lock rod 210 is located on an opening path of an openable component such as a door or drawer of the cabinet to prohibit the opening of such component to lock the cabinet. That is, the lock rod 200 can rotate around the center line of the X-axis direction (i.e. the center line of the second lock rod 220) as an axis, and the first lock rod 210 of the lock rod 200 is used to be directly fitted to the door or drawer for locking or unlocking. Secondly, the lock rod 200 is kept in a rotatable state and the first lock rod 210 is rotated from a locked position to an unlocked position; i.e. the first lock rod 210 is rotated and displaced from the opening path of the door or drawer to leave the opening path of the door or drawer, and the cabinet returns to a state where the cabinet can be freely opened or closed for use.

Before the locking operation, the cabinet is first returned to a closed state, i.e. the door or drawer is closed and then the locking operation is performed.

The locking operation includes the following steps:

Firstly, the lock rod 200 is placed in a rotatable state, wherein the lock rod 200 can be kept in a rotatable state after being unlocked, or the lock rod 200 or the locking assembly 300 can be operated in advance during the locking operation so that the lock rod 200 is in a rotatable state; and the first lock rod 210 is rotated from the unlocked position to the locked position. The first lock rod 210 may be rotated in a direction reverse to the rotation direction upon unlocking or may continue to be rotated in the unlocking direction to reach the locked position. The specific rotation depends on the structural arrangement of the lock rod 200. When the lock rod is rotatably arranged at 360°, both reverse rotation and continued rotation are feasible; but when the lock rod cannot be rotatably arranged at 360°, reverse rotation must be performed.

Secondly, the locking assembly 300 and the lock rod 200 are displaced relative to each other in the X-axis direction along a direction opposite to the unlocking direction, and the second lock rod 220 of the lock rod 200 is engaged with the locking assembly 300, so that the rotation of the second lock rod 220 around the X-axis direction is locked by the locking assembly 300, the second lock rod 220 cannot rotate around the X-axis direction, and the first lock rod 210 cannot be rotatably arranged, thus locking the cabinet.

In some embodiments, a first locking member 230 is arranged on the second lock rod 220; more specifically, the first locking member 230 is arranged at the second end of the second lock rod 220; and the first locking member 230 includes a locking base 232 and a first locking unit 231. The first locking member 230 may be formed by a part or an end of the second lock rod 220, or may be formed by a separate component and fixedly connected to the second lock rod 220.

Moreover, the locking assembly 300 is configured to include a locking member 310. The locking member 310 is internally provided with a locking cavity 311 into which the first locking member 230 can be fitted; and the locking cavity 311 is internally provided with a second locking unit 312. The number of the second locking unit 312 may be one, two or more, and the first locking member 230 correspondingly has several first locking units 231.

The first locking unit 231 is preferably a protrusion or groove arranged on the locking base 232, and the second locking unit 312 is preferably a groove or protrusion matching the first locking unit 231, so that the first locking member 230 and the locking member 310 cannot rotate relative to each other when the first locking unit 231 cooperates with the second locking unit 312.

The locking member 310 is non-rotatably arranged in the lock body 100 around the X-axis direction, including being completely arranged in the lock body 100 and partially arranged in the lock body 100; i.e. whether the locking member 310 can be freely displaced leftward or rightward in at least one of the X-axis direction, the Y-axis direction or the Z-axis direction, but cannot rotate around the around the X-axis direction. However, the lock rod 200 is rotatably arranged in the lock body 100 around the X-axis direction as an axis. Therefore, when the first locking member 230 of the second lock rod 220 is fitted to the locking member 310, the rotation of the second lock rod 220 around the X-axis direction is locked and hence the first lock rod 210 cannot be rotated; but when the first locking member 230 is disengaged from the locking member 310, the second lock rod 220 returns to be rotatably arranged in the lock body 100 around the X-axis direction and hence the first lock rod 210 returns to be rotatable.

Figure 2:
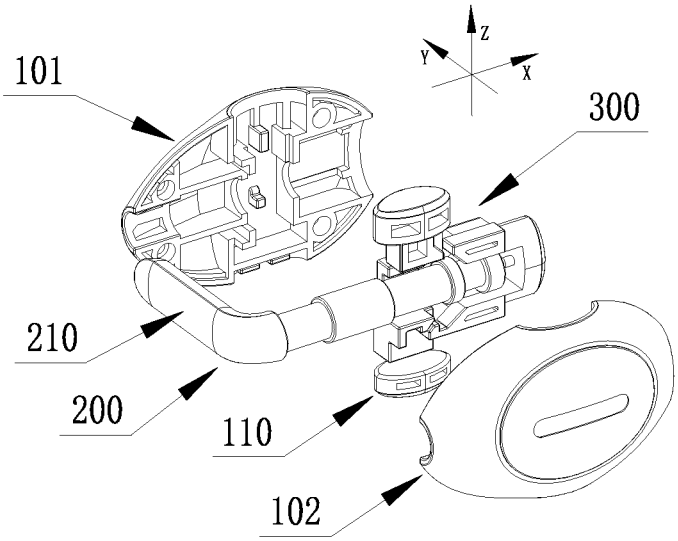
FIG. 2 is a schematic structural exploded view of the embodiment of FIG. 1.

The first locking member 230 of the second lock rod 220 can be fitted to the locking member 310 of the locking assembly 300 in various manners, including but not limited to: allowing the locking member 310 to be displaced relative to the second end of the second lock rod 220 in the X-axis direction, the Y-axis direction, the Z-axis direction or in multiple directions at the same time; for example, as shown in FIG. 2, the locking member 310 can be arranged to displace leftward or rightward in the X-axis direction; or alternatively, as shown in FIG. 2, the locking member 310 can be arranged to displace leftward or rightward in the Y-axis direction, so that the locking member 310 can be engaged with or disengaged from the lock rod 200.

During the unlocking operation, the locking member 310 is operated to have a relative displacement with respect to the second lock rod 220, the locking member 310 is disengaged from the first locking member 230, and the lock rod 200 is transitioned from a state where its rotation is locked to be freely rotatably arranged around the X-axis direction; and the lock rod 200 is rotated so that the first lock rod 210 is rotated from the locked position to the unlocked position to complete the unlocking operation.

During the locking operation, the lock rod 200 is rotated so that the first lock rod 210 is rotated from the unlocked position to the locked position, the locking member 310 is displaced relative to the second lock rod 220 so that the locking member 310 is engaged with the first locking member 230, and the lock rod 200 is transitioned from a state of being freely rotatable around the X-axis direction to a state where its rotation is locked to complete the locking operation. The displacement of the locking member 310 relative to the second lock rod 220 may be a relative displacement caused by an external force, or may be automatically reset by a reset structure.

In other embodiments, the second lock rod 220 is provided with several increased diameter sections and reduced diameter sections with different outer diameters, the lock body 100 is internally correspondingly provided with increased diameter grooves and reduced diameter grooves with different inner diameters, and when the increased diameter sections and the reduced diameter sections of the second lock rod 220 are fitted into the increased diameter grooves and the reduced diameter grooves of the lock body 100, the second lock rod 220 can rotate around the X-axis direction, but the left-right displacement of the second lock rod 220 in the X-axis direction is prohibited, so that the lock rod 200 is arranged in the lock body 100 by being able to rotate around the X-axis direction but unable to translate leftward or rightward along the X axis. Moreover, the lock body 100 is also internally provided with a locking member groove in the X-axis direction, the locking member 310 is at least partially arranged in the locking member groove, the fitting relationship between the locking member 310 and the locking member groove is that the locking member 310 can only be arranged to translate leftward or rightward in the X-axis direction, and the locking member 310 neither can be displaced in the Y-axis and Z-axis directions, nor can rotate around the X-axis direction as an axis. In a locked state, the first locking member 230 at the second end of the second lock rod 220 is fitted to the locking member 310, and the locking member 310 cannot rotate around the X-axis direction, so that the rotation of the second lock rod 220 around the X-axis direction is also locked, and the first lock rod 210 cannot rotate to form a locked state.

The locking member 310 is operated to be displaced leftward or rightward in the X-axis direction, the first locking unit 231 is disengaged from the second locking unit 312, the locking member 310 no longer limits the rotation of the second lock rod 220 around the X-axis direction, and the lock rod 200 returns to be rotatably arranged around the X-axis direction.

Preferably, the second lock rod 220 is sequentially provided with a locking base 232 and a rotating member 233 at the second end in the X-axis direction, wherein the locking base 232 is an annular member arranged along a circumferential direction of the second lock rod 220, the rotating member 233 is an annular groove arranged along the circumferential direction of the second lock rod 220, the first locking unit 231 is a groove arranged on the locking base 232, and the first locking unit 231 is most preferably flush with the rotating member 233. When the second locking unit 312 is fitted into the first locking unit 231, the rotation of the second lock rod 220 is limited by the locking member 310. When the second locking unit 312 is fitted into the rotating member 233, the second lock rod 220 can rotate around the X-axis direction as an axis.

Most preferably, the locking base 232 is arranged outside of the rotating member 233, and the locking member 310 is displaced in a negative direction along the X axis and then displaced from being fitted into the first locking unit 231 to being fitted into the rotating member 233, so that the rotation of the second lock rod 220 around the X-axis direction is transitioned from being limited to rotatable. When the number of the first locking unit 231 and the second locking unit 312 is two or more, the locking units are preferably evenly arranged along the circumferential direction of the second lock rod 220. For example, when the number of the first locking unit 231 and the second locking unit 312 is respectively two, the locking units are arranged at an angle of 180° to each other. Of course, uneven arrangement is also feasible, as long as the positions of the first locking unit 231 and the second locking unit 312 correspond to each other.

In other embodiments, the unlocking operation further includes a pre-unlocking step, wherein the lock body 100 is internally provided with a pre-unlocking member 320 arranged on a displacement path of the locking member 310 or the second lock rod 220. During the unlocking operation, the pre-unlocking member 320 must be operated to be displaced and deviated from the displacement path, so that the locking member 310 and the second lock rod 220 can be displaced relative to each other and hence the lock rod 200 returns to a rotatable state. If the pre-unlocking member 320 is not operated in advance, and the locking member 310 or the second lock rod 220 is directly operated, the member or the rod may be blocked by the pre-unlocking member 320 and cannot be completely displaced to unlock the lock rod 200. In this way, the safety of the unlocking operation can be effectively improved, thus avoiding safety problems caused by unauthorized operation by children.

The pre-unlocking member 320 can preferably be arranged to displace reciprocally in the Z-axis or Y-axis direction, and the relative displacement of the locking member 310 with respect to the second lock rod 220 is locked through its displacement in the Z-axis or Y-axis direction.

More preferably, the pre-unlocking member 320 further includes a first blocking portion 321 and a first guide portion 322; the locking member 310 is further provided with a second blocking portion 313 and a second guide portion 314; the first blocking portion 321 and the second blocking portion 313 are arranged at corresponding positions; and when the pre-unlocking member 320 is not displaced, the displacement of the locking member 310 relative to the second lock rod 220 allows the first blocking portion 321 to abut against the second blocking portion 313, so that the displacement of the locking member 310 relative to the second lock rod 220 cannot meet the unlocking requirement. The pre-unlocking member 320 is operated to be displaced by a certain distance in a Z-axis or Y-axis direction so as to deviate the first blocking portion 321 from the second blocking portion 313, and the first blocking portion 321 does not cooperate with the second blocking portion 313 when the locking member 310 is displaced relative to the second lock rod 220; meanwhile, the first guide portion 322 cooperates with the second guide portion 314 when the locking member 310 is displaced relative to the second lock rod 220, and under the guiding action of the first guide portion 322 and the second guide portion 314, the displacement of the locking member 310 drives the pre-unlocking member to further displace correspondingly in its displacement direction. In this way, the unlocking operation process can be simplified. Before unlocking, it is only necessary to operate the pre-unlocking member 320 to displace by a small distance so as to deviate the two blocking portions, which can take into account the safety and convenience in operation.

In other embodiments, the unlocking operation further includes an auxiliary unlocking step, wherein an auxiliary unlocking member 330 is arranged on the lock body 100, and at least a part of the auxiliary unlocking member 330 is arranged in the lock body 100. The auxiliary unlocking member 330 is non-displaceably arranged in the X-axis direction. The auxiliary unlocking member 330 is displaceably arranged in at least one of the Y-axis and Z-axis directions. The auxiliary unlocking member 330 is provided with a first hook member 331, and the locking member 310 is provided with a second hook member 315 that can match the first hook member 331; and when the locking member 310 is displaced to the unlocked position, the first hook member 331 cooperates with the second hook member 315 to limit the locking member 310 and keep the locking member at this position. In this way, after the unlocking operation is completed, the locking member 310 can be kept in an unlocked state without the need to continuously apply a force thereto; and it is also unnecessary to operate the locking member 310 again during the locking operation, thereby simplifying the operation.

More preferably, the first hook member 331 and the second hook member 315 are also respectively provided with guide portions that cooperate with each other, so that the displacement of the locking member 310 in the X-axis direction drives the auxiliary unlocking member 330 to displace correspondingly, and hence the first hook member 331 automatically cooperates with the second hook member 315 without additional operation of the auxiliary unlocking member 330. Of course, if the above guide portions are not provided, it is also feasible to operate the auxiliary unlocking member 330 separately, which can be done by operating the auxiliary unlocking member 330 to be displaced to a desired position, then operating the locking member 310 to be displaced to the unlocked position, and then operating the auxiliary unlocking member 330 so that the first hook member 331 cooperates with the second hook member 315 to lock the displacement of the locking member 310 in the X-axis direction and keep the locking member in an unlocked state.

Most preferably, the second lock rod 220 is further provided with a top block 224, and the auxiliary unlocking member 330 is provided with a top hole 332 in cooperation with the top block 224. After the locking member 310 is displaced in the X-axis direction, the second lock rod 220 returns to a state of being freely rotatable around the X axis, and the second hook member 315 of the locking member 310 cooperates with the first hook member 331 of the auxiliary unlocking member 330 to limit the displacement of the locking member 310 in the X-axis direction and keep the locking member at this position, thereby keeping the lock rod 200 in a rotatable state. The first lock rod 210 is rotated from the locked position to the unlocked position, the top block 224 acts on the top hole 332 as the second lock rod 220 rotates, so that the auxiliary unlocking member 330 is displaced upward along the Z axis, the first hook member 331 is disengaged from the second hook member 315, and the locking member 310 is displaced by an appropriate distance in a direction opposite to the displacement direction upon unlocking to partially reset; and the second locking unit 312 is still located in the rotating member 233 and abuts against an edge of the locking base 232.

When the second lock rod 220 is rotated in an opposite direction from an unlocked state to a locked state, the second locking unit 312 is rotated in the rotating member 233 and fitted into the first locking unit 231 to completely reset, and the pre-unlocking member 320 and the auxiliary unlocking member 330 are respectively displaced in the positive and negative directions of the Z axis to reset respectively. Since the locking member 310 has been partially reset in advance, the first hook member 331 is not engaged with the second hook member 315 to limit the locking member 310 when the second lock rod 220 is reversely rotated.

When the lock rod 200 is rotated from the unlocked position to the locked position, in order to avoid that the locking member 310 is limited by the auxiliary unlocking member 330 and cannot be reset due to the cooperation between the first hook member 331 and the second hook member 315, the first hook member 331 and the second hook member 315 are respectively provided with matching planar portions, and when the top block 224 acts on the top hole 332 to displace the locking member 310 reversely by a small distance, the planar portions on the first hook member 331 and the second hook member 315 abut against each other to prevent the cooperation between the two hook members. Most preferably, return springs (not shown) for automatic reset of related components are preferably arranged between the locking member 310 and the lock body 100 or the second lock rod 220, between the pre-unlocking member 320 and the lock body 100, and between the auxiliary unlocking member 330 and the lock body 100.

The arrangement of the top block 224 and the top hole 332 allows that the lock rod 200 can be kept in a rotatable state after unlocking, the lock rod 200 can be directly rotated to the locked position during locking, and the locking cooperation can be automatically completed to return the lock rod 200 to a locked state. In other words, in the unlocking and locking method of the cabinet lock, the pre-unlocking member 320 and the locking member 310 need to be operated separately to unlock the lock rod 200 during unlocking; and after the cabinet is normally used, the lock rod 200 is simply operated to rotate to the locked position, and the locking process of the cabinet lock is automatically reset under the action of the return springs.

A cabinet safety lock includes a lock body 100, a lock rod 200 and a locking assembly 300, wherein the lock rod 200 and the locking assembly 300 are both arranged on the lock body 100.

The lock body 100 can preferably be formed by the cooperation between a base 101 and an upper cover 102, which can be fixed and fitted by means of clamping, screw fixing, adhering, etc.; and after the cooperation, a chamber is also formed in the lock body 100 for at least a part of the lock rod 200 and the locking assembly 300 to be disposed therein, thus forming the cabinet safety lock. The base 101 is fixed along the YX plane, and the lock rod 200 is rotatably arranged on the lock body 100 around the X-axis direction as an axis.

The lock rod 200 includes a first lock rod 210 and a second lock rod 220 which are arranged at an included angle. Preferably, the first lock rod 210 and the second lock rod 220 are arranged at an angle of 90° or close to 90° to form an L-shaped or approximately L-shaped lock rod 200. The second lock rod 220 is rotatably arranged on the lock body 100 with its center line as an axis (i.e. the X-axis direction), and the locking assembly 300 cooperates with the second lock rod 220 to lock or unlock the rotation of the lock rod 200. Therefore, when the lock rod 200 is rotated to different angles around the axis of the second lock rod 220 (i.e. the center line of the second lock rod 220), the first lock rod 210 is at different positions, so that the first lock rod 210 is formed in a locked or unlocked state. Apparently, the first lock rod 210 is arranged in the Y-axis direction while the second lock rod is arranged in the X-axis direction.

To fix the lock rod 200 in a locked or unlocked state, the second lock rod 220 is provided with a first locking member 230. The first locking member 230 includes a locking base 232 and a first locking unit 231. The first locking member 230 may be formed by a part or an end of the second lock rod 220, or may be formed by a separate component and fixedly connected to the second lock rod 220.

The locking assembly 300 includes a locking member 310. The locking member 310 is internally provided with a locking cavity 311 into which the first locking member 230 can be fitted; and the locking cavity 311 is also internally provided with a second locking unit 312.

The first locking unit 231 is preferably a protrusion or groove arranged on the locking base 232, and the second locking unit 312 is preferably a groove or protrusion matching the first locking unit 231, so that the first locking unit 231 and the second locking unit 312 cannot rotate relative to each other after their cooperation. Of course, other structures capable of non-rotatably cooperating the first locking unit 231 with the second locking unit 312 are also feasible.

Preferably, in the above case, the locking base 232 has a cylindrical shape to facilitate the rotatable arrangement of the second lock rod 220.

In addition, the locking member 310 is configured to be non-rotatably arranged on the lock body 100. When the protrusion or groove as the first locking unit 231 cooperates with the groove or protrusion as the second locking unit 312, since the locking member 310 is non-rotatably arranged on the lock body 100, the rotation of the second lock rod 220 around its own axis (i.e. the X-axis direction) is locked through the cooperation between the first locking unit 231 and the second locking unit 312, so that the second lock rod 220 is locked relative to the lock body 100; and when the first locking unit 231 is displaced by a certain distance relative to the second locking unit 312 along the axis of the second lock rod 220, the first locking unit 231 is disengaged from the second locking unit 312 so that the second lock rod 220 can rotate around its axis. In this case, whether the first locking member 230 is still located in the locking cavity 311 or completely disengaged therefrom is feasible and not limited. In a preferred embodiment, the lock rod 200 is rotatably arranged in the lock body 100 with its center line in the X-axis direction as an axis; and the locking member 310 is displaceably arranged in the X-axis direction. Specifically, the locking member is displaceably arranged on the lock body 100 by providing a guide groove in the lock body 100 and a guide block on the locking member 310.

When the locking member 310 is located at a proper position in the lock body 100, the second locking unit 312 on the locking member 310 cooperates with the first locking unit 231 on the second lock rod 220, so that the rotation of the lock rod 200 along the X axis as an axis is locked by the locking member 310 and hence cannot rotate freely. In this case, the first lock rod 210 cooperates with the lock body 100 to lock the cabinet so as to form a locked state, and the position of the locking member 310 is its locked position.

When the locking member 310 is translated by a certain distance in the X-axis direction (the translation direction may be in the positive direction of the X axis, or in the negative direction of the X axis, which is not limited), the second locking unit 312 is disengaged from the first locking unit 231, the lock rod 200 returns to be able to rotate along the X axis as an axis, and the first lock rod 210 is rotated at an appropriate angle by rotating the lock rod 200, so that the cabinet cannot be locked through the cooperation between the first lock rod 210 and the lock body 100, thus forming an unlocked state; and the position of the locking member 310 is its unlocked position.

For example, as shown in FIG. 1, the second lock rod 220 is arranged in the X-axis direction and rotatably arranged around its center line, and the first lock rod 210 and the second lock rod 220 are arranged at an included angle of 90°. The lock body 100 is fixed along the X-Z plane. In a locked state, the first lock rod 210 is arranged in the positive direction of the Y-axis to cooperate with the lock body 100 so as to form a locked state, and then the locking member 310 cooperates with the first locking member 230 to prohibit the rotation of the second lock rod 220. When unlocking is required, the locking member 310 is operated to be displaced in the positive or negative direction of the X axis, the locking member 310 is disengaged from the first locking member 230, the lock rod 200 is rotated clockwise or counterclockwise by 90°-270°, the first lock rod 210 is formed in an unlocked state, and the door or drawer of the cabinet can be normally opened. The rotation angle of the lock rod 200 is preferably 90°-180°, most preferably 90°. In this way, the rotation angle is small to facilitate operation, and the first lock rod 210 may not extend out.

In the cabinet safety lock, the locking or unlocking of the rotation of the lock rod 100 is mainly achieved by the displacement of the locking member 310 in the X-axis direction, and the lock rod 200 is preferably configured to be non-displaceable in the X-axis direction (excluding tiny displacement caused by machining or assembly errors). For this reason, different parts of the second lock rod 200 can be configured to have different outer diameters, and the internal shape of the lock body 100 is changed correspondingly to form rotating fixing cavities with different inner diameters, so that the second lock rod 220 can hardly be displaced leftward or rightward in the X-axis direction after being fitted to the lock body 100. Of course, if the lock rod 200 is arranged to be able to have a certain displacement in the X-axis direction, but its displacement in the X-axis direction is insufficient to disengage the first locking member 230 from the locking member 310, which is also feasible in practical applications.

In other embodiments, the locking member 310 can also be fixedly arranged on the lock body 100, and the lock rod 200 is arranged on the lock body 100 by being able to rotate around the X axis and displace leftward or rightward along the X axis (i.e. to displace in the positive or negative direction of the X axis). In this case, the locking member 310 and the first locking member 230 can have the above-mentioned structure. Moreover, the locking member 310 may be a separate internal member, or may be formed on the lock body 100, which is not limited.

Apparently, in this embodiment, the lock rod 200 is configured to be able to displace leftward or rightward along the X axis, so the displacement of the first lock rod 210 along the X axis may change during use. In other words, there are two implementations, i.e. the first lock rod 210 is pressed or substantially pressed against a front surface of the cabinet in a locked state, and the first lock rod 210 is pulled outward and then rotated by 90°-270° to form an unlocked state during unlocking; and the first lock rod 210 is at a proper distance from the front surface of the cabinet in a locked state, and the first lock rod 210 is pushed inward and then rotated by 90°-270° to form an unlocked state during unlocking. Of course, the rotation angle can also be optimized to the most preferred 90° as described above.

For a cubic cabinet, its front surface is parallel to the Y-Z plane and its side surface is parallel to the Z-X plane. The lock body 100 is fixed at an appropriate position on the side surface, and the first lock rod 210 extends into the front surface of the cabinet in a locked state.

In other embodiments, the lock rod 200 cannot be displaced in the X-axis direction, the locking member 310 is displaced along the negative direction of the X axis to be unlocked, and the second lock rod 220 is further provided with a rotating member 233, so that the lock rod 200 returns to be rotatably arranged when the second locking unit is fitted into the rotating member 233. For example, when the first locking unit 231 is a groove arranged on the locking base 232 and the second locking unit 312 is a protrusion matching the first locking unit 231, the rotating member 233 is a rotating member 233 into which the protrusion as the second locking unit 312 can be fitted.

In an initial circumstance, the second locking unit 312 on the locking member 310 cooperates with the first locking unit 231 on the first locking member 230 to prohibit the rotation of the lock rod 200; when the locking member 310 is displaced by an appropriate distance in the negative direction of the X axis, the second locking unit 312 is transitioned from cooperating with the first locking unit 231 to cooperating with the rotating member 233; and the rotating member 233 is a circumferential groove arranged along an outer wall of the second lock rod 220 and has a size greater than the second locking unit 312, and the lock rod 200 can rotate around the X axis as an axis when the second locking unit 312 is fitted into the rotating member 233, so that the first lock rod 210 rotates correspondingly for unlocking.

The rotating member 233 may be arranged along the entire circumference of the second lock rod 220, so that the rotation angle of the lock rod 200 around the X axis is not limited thereby; and the rotating member may also be arranged along a part of the circumference of the second lock rod 220, e.g. only covering 90°, 180° or other appropriate angles of its circumference, which may limit the rotation angle of the lock rod 200 around the X axis. Of course, restricting the rotation angle of the lock rod 200 by the rotating member 233 does not mean that the lock rod 200 can necessarily rotate freely within 360°, and other additional rotation angle restriction structures can also be provided to control the rotation angle of the lock rod; for example, at other positions of the second lock rod 220, a ring groove covering only a part of the angular range of its circumference is provided to cooperate with the protrusion arranged on the lock body 100 to limit the rotation angle of the lock rod 200.

In some embodiments, the locking cavity 311 of the locking member 310 has a U-shaped opening, and a semicircular groove at the bottom is used for the first locking member 230 to be rotatably fitted therein.

In other embodiments, the locking assembly 300 further includes a pre-unlocking member 320 movably arranged in the Z-axis direction, wherein the pre-unlocking member 320 is provided with a first blocking portion 321, the locking member 310 is provided with a second blocking portion 313, and the first blocking portion 321 and the second blocking portion 313 are cooperatively arranged to limit the displacement of the locking member 310 in the X-axis direction. Specifically, the pre-unlocking member 320 is displaceably arranged on a displacement path of the locking member 310; and, in a locked state, the first blocking portion 321 is located in front of the second blocking portion 313 to prevent the second blocking portion 313 and the locking member 310 from being displaced in the lock body 100. In other words, in a locked state, the pre-unlocking member 320 locks the displacement of the locking member 310, the locking member cannot be displaced and unlocked by directly operating the locking member 310, and the pre-unlocking member 320 must be operated to release the displacement locking of the locking member 310.

Moreover, the pre-unlocking member 320 is further provided with a first guide portion 322, and the locking member 310 is provided with second guide portion 314. In the initial displacement stroke of the auxiliary unlocking member 330, the first blocking portion 321 cooperates with the second blocking portion 313, and the pre-unlocking member 320 must be operated to disengage the two blocking portions; and then the first guide portion 322 cooperates with the second guide portion 314, and the displacement of the locking member 310 along the X axis can drive the pre-unlocking member 320 to displace correspondingly in the Y-axis direction through the action of the two guide portions. Of course, other structures that can lock the displacement of the locking member 310 can also be achieved. For example, the locking member 310 is provided with a locking hole in the Y-axis or X-axis direction, and the pre-unlocking member 320 is configured as a needle-like structure that can be inserted into the locking hole. Alternatively, the pre-unlocking member 320 is movably arranged in the Y-axis direction; or the pre-unlocking member 320 is displaceably arranged in the Y-axis and Z-axis directions at the same time.

In other embodiments, the locking assembly 300 further includes an auxiliary unlocking member 330 which is provided with a first hook member 331, and the locking member 310 is correspondingly provided with a second hook member 315. The first hook member 331 and the second hook member 315 are respectively provided with matching hook members that cooperate with each other to fix the position of the locking member 310 after displacement.

Figure 3:
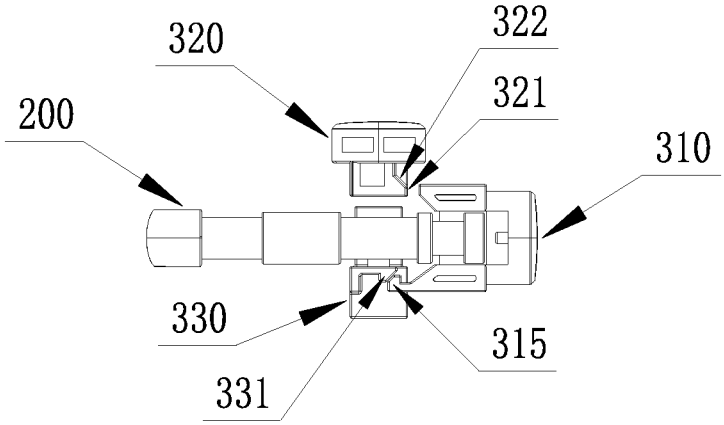
FIG. 3 is a front view showing the cooperation between a lock rod and a locking assembly in the embodiment of FIG. 1, which is a schematic diagram viewed in the positive direction of the Y axis.
Figure 4:
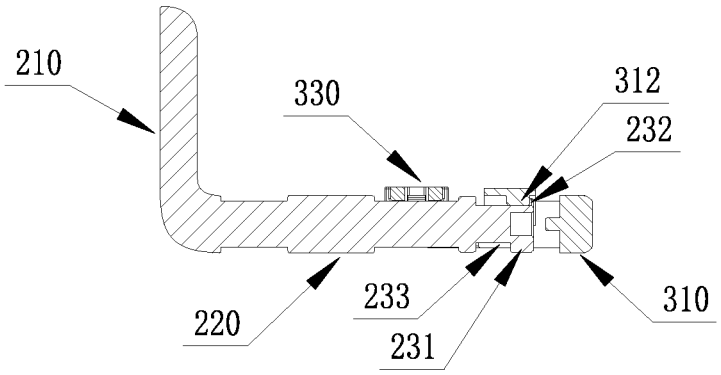
FIG. 4 is a cross-sectional view taken along the central position along the XY plane in FIG. 3.
Figure 5:
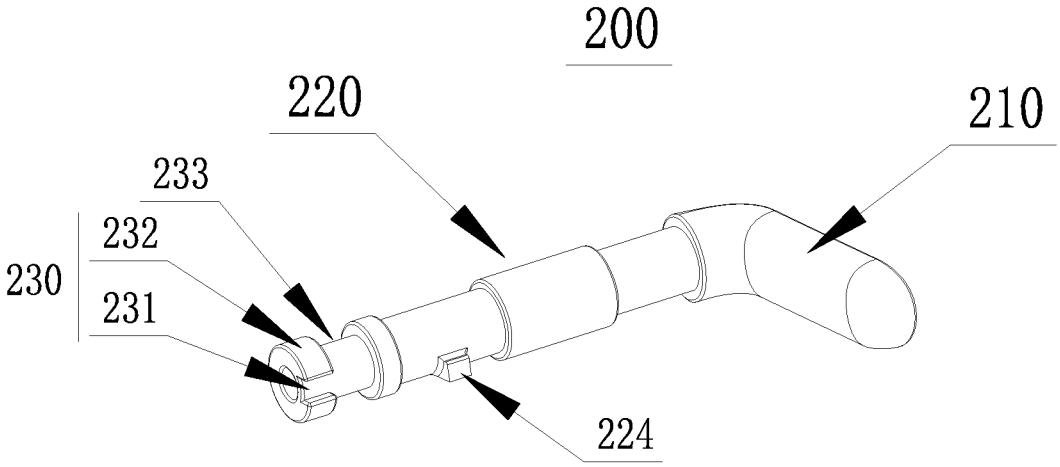
FIG. 5 is a schematic structural view of the lock rod in the embodiment of FIG. 1.
Figure 6:
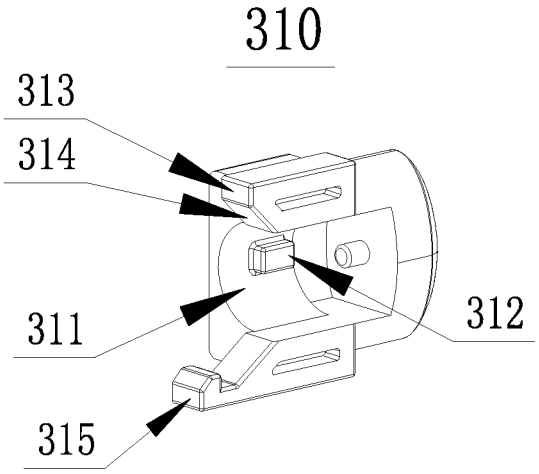
FIG. 6 is a schematic structural view of a locking member in the embodiment of FIG. 1.
Figure 7:
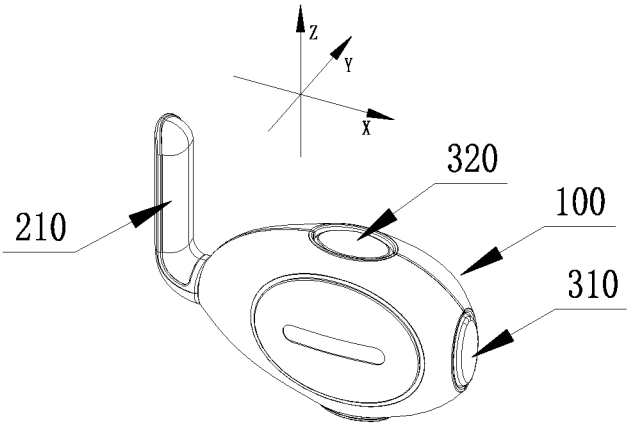
FIG. 7 is a three-dimensional schematic structural view of the cabinet safety lock in an unlocked state according to the embodiment of FIG. 1; wherein a lock rod 200 is rotated by 90° relative to the locked state shown in FIG. 1 to form the unlocked state.

For example, as shown in FIG. 3, in an initial circumstance, the locking member 310 cooperates with the second lock rod 220 to lock the second lock rod 220; and after the pre-unlocking member 320 and the auxiliary unlocking member 330 are operated, a force is applied to displace the locking member 310 leftward along the X axis, the rotation locking of the second lock rod 220 is released, and the auxiliary unlocking member 330 is released to allow cooperation between the hook members on the first hook member 331 and the second hook member 315 so as to confine and maintain the locking member 310 at the unlocked position.

After the cabinet safety lock is operated as described above, the locking member 310 is hooked by the auxiliary unlocking member 330 and hence locked in the X-axis direction, the first locking unit 231 is fitted into the circumferential groove as the rotating member 233, and the lock rod 200 can rotate clockwise or counterclockwise around the X axis. When the first lock rod 210 is rotated by 90°, its limiting effect on the door and the like is released; and the top block 224 arranged on the second lock rod 220 abuts against the top hole 332 on the auxiliary unlocking member 330, so that the auxiliary unlocking member 330 is displaced upward, and the first hook member 331 is disengaged from the second hook member 315. The second locking unit 312 is still located in the rotating member 233 and defined by a side wall of the locking base 232.

When the cabinet lock needs to be returned to a locked state, the first lock rod 210 is reversely rotated, then the top block 224 is disengaged from the top hole 332, and the auxiliary unlocking member 330 is reset; and the second locking unit 312 is rotated by a corresponding angle in the circumferential groove as the rotating member 233 and then fitted into the groove as the first locking unit 231, and the locking member 310 is also reset.

Return springs (not shown) for automatic reset of related components are preferably arranged between the locking member 310 and the lock body 100 or the second lock rod 220, between the pre-unlocking member 320 and the lock body 100, and between the auxiliary unlocking member 330 and the lock body 100.

Therefore, when the first lock rod 210 is rotated by 90° to the unlocked position, the first hook member 331 is disengaged from the second hook member 315, and the locking member 310 is displaced backward by a certain distance and then defined by the side wall of the locking base 232; and when the first lock rod 210 is reversely rotated to the locked position, the first hook member 331 does not cooperate with the second hook member 315 (otherwise, the locking member 310 cannot be reset).

When the lock rod 200 is rotated from the unlocked position to the locked position, in order to avoid that the locking member 310 is limited by the auxiliary unlocking member 330 and cannot be reset due to the cooperation between the first hook member 331 and the second hook member 315, the first hook member 331 and the second hook member 315 are respectively provided with matching planar portions, and when the top block 224 acts on the top hole 332 to displace the locking member 310 reversely by a small distance, the planar portions on the first hook member 331 and the second hook member 315 cooperate with each other to prevent the cooperation between the two hook members. Of course, it can also be controlled by the reverse displacement of the locking member 310, which can be achieved by adjusting the width of the circumferential groove as the rotating member 233 and the width of the locking base 232.

Preferably, the first hook member 331 and the second hook member 315 are also respectively provided with guide portions; therefore, when the locking member 310 is displaced leftward, the auxiliary unlocking member 330 can be displaced through the cooperation between the guide portions on the first hook member 331 and the second hook member 315, so that the two hook members cooperate with each other.

In some embodiments, the lock body is further provided with a button 110 which has no practical function and is not functionally connected with other components; but the button 110 can provide the same operation feedback as a real button and therefore can be confusing, thereby preventing opening by children.

Figure 8:
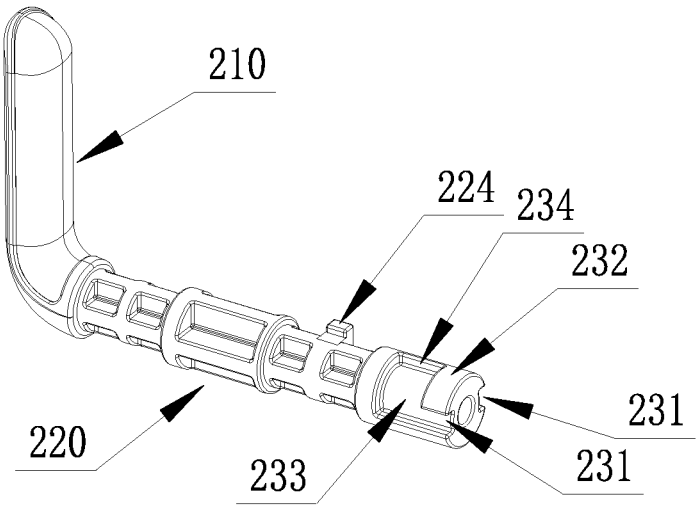
FIG. 8 is a schematic structural view of a lock rod of another embodiment; wherein the lock rod is mainly different from the lock rod shown in FIG. 5 in that the first locking member and the rotating member have different structures, and the lock rod has two first locking units; and the rotating member also has a limiting block that limits the rotation of the lock rod.
Figure 9:
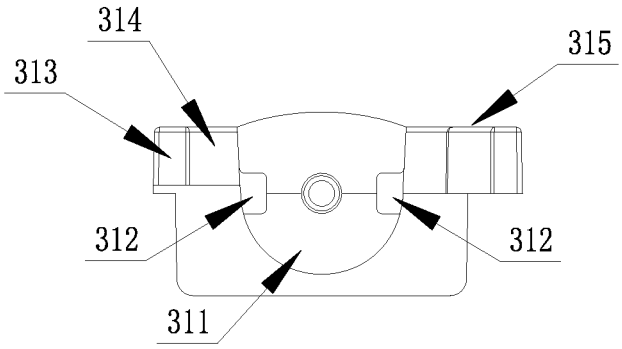
FIG. 9 is a schematic structural view of a locking member matching the lock rod of FIG. 8; wherein the locking member is the same as the locking member shown in FIG. 6 except that the position and number of the second locking unit are different.
Figure 10:
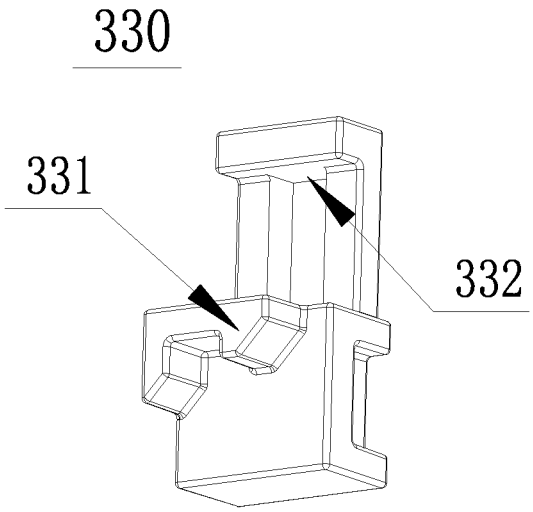
FIG. 10 is a schematic structural view of an auxiliary unlocking member of the embodiment of FIG. 1.
Figure 11:
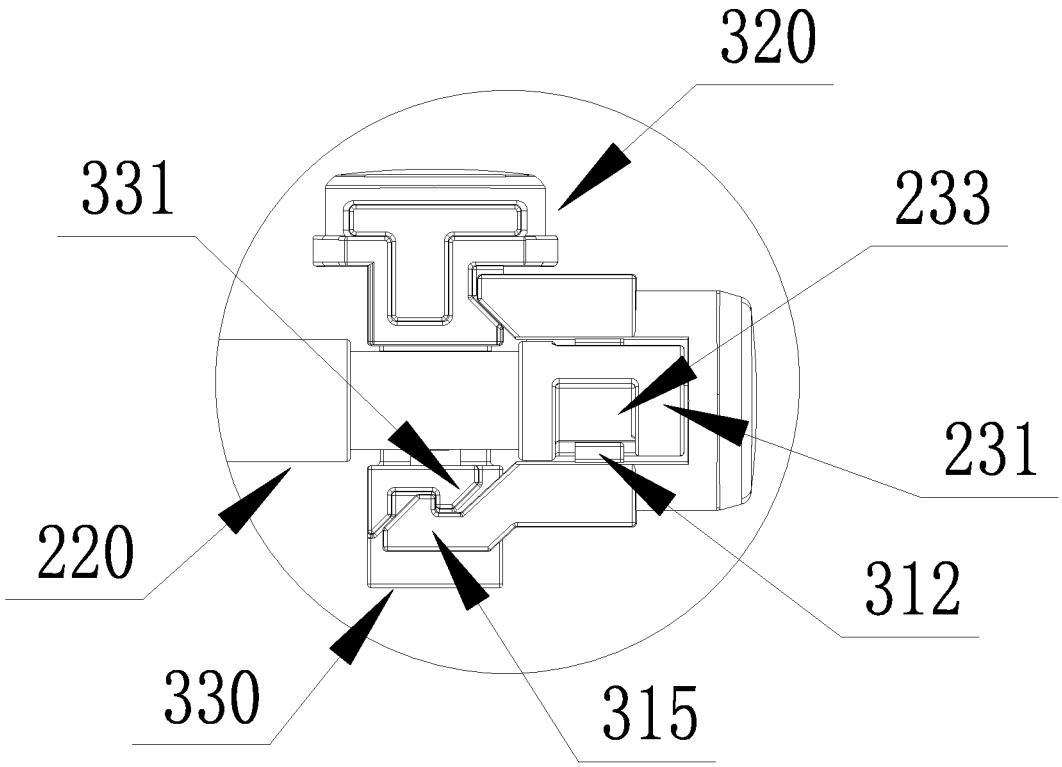
FIG. 11 shows a fitting state of the cabinet safety lock of the embodiment of FIG. 2 formed after the locking member is pressed; wherein the second locking unit is displaced from the first locking unit into a circumferential groove as the rotating member, and hook members of a first hook member and a second hook member cooperate with each other to limit the locking member.
Figure 12:
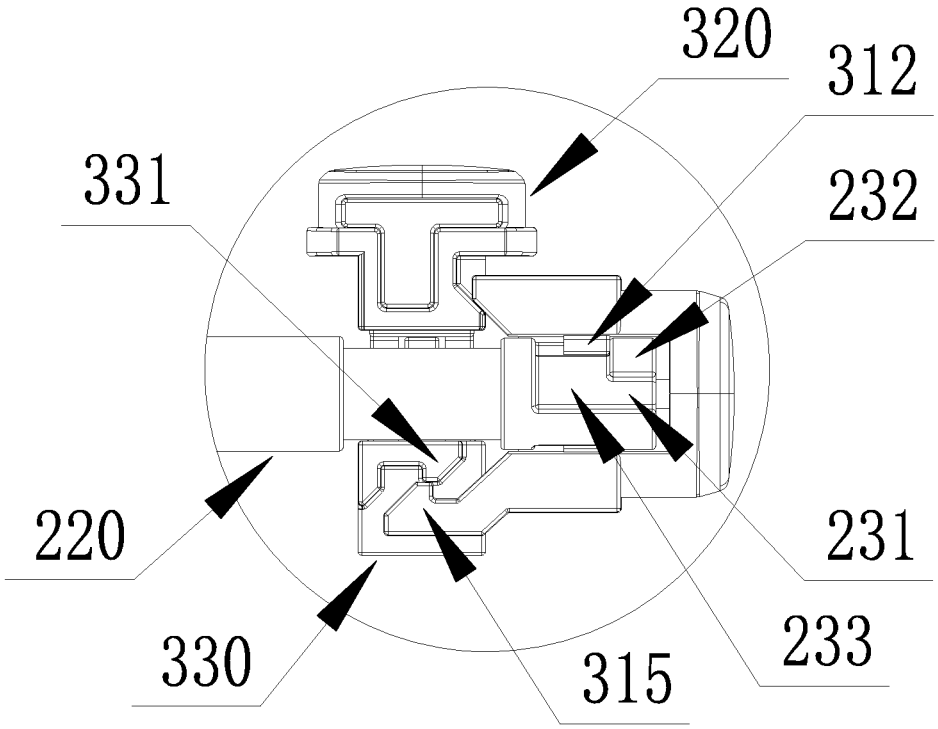
FIG. 12 is a schematic view showing the fitting of the cabinet safety lock of the embodiment of FIG. 2 when a first lock rod is rotated to an unlocked position; wherein the auxiliary unlocking member is displaced upward under the action of a second lock rod, the locking member is retracted rightward by an appropriate distance so that the second locking unit abuts against a side wall of a locking base to limit the locking member, the first hook member is disengaged from the second hook member and planar portions of the two hook members cooperate with each other to prevent the cooperation between the two hook members. On this basis, if the second lock rod is reversely rotated to form a locked state, the locking member, the pre-unlocking member and the auxiliary unlocking member are to be reset respectively.

As shown in FIGS. 8 and 9, in other preferred embodiments, the first locking member 230 consists of a locking base 232 and two first locking units 231 arranged thereon, and the two first locking units 231 are arranged at an angle of 180°. Accordingly, two second locking units 312 are also correspondingly arranged in the locking member 310. When the two second locking units 312 of the locking member 310 are fitted into the two first locking units 231 of the first locking member 230, the rotation of the lock rod 200 relative to the lock body 100 is locked, so that the first lock rod 210 is formed in a locked state.

In order to limit the rotation angle of the lock rod 200, the rotating member 233 is changed from a groove portion disposed around the circumference of the second lock rod 200 to be only arranged at a certain angle along the circumferential direction of the second lock rod 200. For example, as shown in FIG. 8, the rotating member 233 covers about ¼ of the circumference of the second lock rod 200, i.e. 90°. When the lock rod 200 rotates, the second locking units 312 move in the rotating member 233, but the locking member 310 cannot rotate; and when the lock rod 200 rotates so that its limiting portion 234 abuts against the second locking units 312, the lock rod 200 cannot further rotate, thereby limiting the rotation angle of the lock rod 200.

Besides, for the purpose of saving materials, it is also possible to provide several member grooves on the second lock rod 220, and the material for the second lock rod 200 is reduced without substantially reducing the structural performance of the second lock rod 200, thereby reducing the overall weight of the lock rod.

The cabinet safety lock according to any one of the above embodiments can be used to implement any unlocking and locking method of the cabinet lock as described above, and can be separately implemented independently of the above method.

The invention claimed is:

1. A cabinet safety lock, including a lock body, a lock rod and a locking assembly, the lock rod and the locking assembly being arranged on the lock body; wherein, the lock rod includes a first lock rod and a second lock rod substantially perpendicular to each other; and the second lock rod is rotatably arranged on the lock body around the X-axis direction as an axis and thus the lock rod is rotatably arranged on the lock body, and the locking assembly is fitted to the second lock rod to lock or unlock the rotation of the lock rod;

the second lock rod is provided with a first locking member including a first locking unit; the locking assembly includes a locking member configured to be non-rotatably disposed on the lock body, the locking member is internally provided with a locking cavity for the first locking member to be fitted therein, and the locking cavity is internally provided with a second locking unit; and at least one of the first locking unit and the locking member is movably arranged in the X-axis direction;

the first locking unit cooperates with the second locking unit so that the rotation of the second lock rod relative to the lock body is locked; and the first locking unit is displaced relative to the locking member in the X-axis direction to disengage the first locking unit from the second locking unit, so that the second lock rod returns to be rotatably arranged relative to the lock body; and the first locking unit and the second locking unit are respectively a groove and a protrusion matching each other, the second lock rod further includes a rotating member which is a circumferential groove arranged along the surface of the second lock rod, and the second locking unit is a protrusion arranged in the locking cavity;

and after the first locking unit is displaced relative to the locking member in the X-axis direction, the second locking unit is fitted into the rotating member.

2. The cabinet safety lock according to claim 1, wherein the locking member is fixedly arranged in the X-axis direction and the second lock rod is movably arranged in the X-axis direction.

3. The cabinet safety lock according to claim 1, wherein the locking member is movably arranged in the X-axis direction; and the first locking member is fixedly arranged in the X-axis direction, or the displacement of the first locking member in the X-axis direction is insufficient to disengage the first locking unit from the second locking unit.

4. The cabinet safety lock according to claim 1, wherein the locking assembly further includes a pre-unlocking member arranged on the lock body, and the pre-unlocking member is movably arranged in the Y-axis or Z-axis direction to limit the displacement of the locking member in the X-axis direction; and the pre-unlocking member is arranged on a displacement path of the locking member and provided with a first blocking portion, the locking member is provided with a second blocking portion, and the first blocking portion cooperates with the second blocking portion to limit the locking member.

5. The cabinet safety lock according to claim 4, wherein the pre-unlocking member is further provided with a first guide portion and the locking member is provided with a second guide portion; the first blocking portion cooperates with the second blocking portion in the initial displacement stroke of the auxiliary unlocking member; and the first guide portion cooperates with the second guide portion in the later stroke.

6. The cabinet safety lock according to claim 4, wherein the locking assembly further includes an auxiliary unlocking member which is provided with a first hook member, and the locking member is provided with a second hook member in cooperation with the first hook member; and the first hook member and the second hook member are also respectively provided with guide portions that cooperate with each other.

7. The cabinet safety lock according to claim 6, wherein the second lock rod is further provided with a top block, and the auxiliary unlocking member is provided with a top hole in cooperation with the top block; and when the lock rod is rotated for unlocking, the second lock rod is rotated to drive the auxiliary unlocking member to displace in the Y-axis or Z-axis direction, so that the first hook member is disengaged from the second hook member and the locking member is partially reset.

8. The cabinet safety lock according to claim 1, wherein the lock body is formed by the cooperation between a base and an upper cover; and the lock body is further provided with a button which is not functionally connected with other components; and the rotating member is arranged along a part of the circumference of the second lock rod, which covers a range of 90°-180° of the circumference of the second lock rod, so that the lock rod is rotated clockwise or counterclockwise by 90°-180° from a locked position to form an unlocked position.

9. A cabinet safety lock, including a lock body, a lock rod and a locking assembly, the lock rod and the locking assembly being arranged on the lock body; wherein the lock rod includes a first lock rod and a second lock rod which are arranged at an included angle; and the second lock rod is rotatably arranged on the lock body around an X-axis direction as an axis so that the lock rod is rotatably arranged on the lock body, and the locking assembly is fitted to the second lock rod to lock or unlock rotation of the lock rod;

the second lock rod is provided with a first locking member including a first locking unit; the locking assembly includes a locking member configured to be non-rotatably disposed on the lock body, the locking member is internally provided with a locking cavity for the first locking member to be fitted therein, and the locking cavity is internally provided with a second locking unit; and at least one of the first locking unit and the locking member is movably arranged in the X-axis direction;

the first locking unit fits with the second locking unit so that rotation of the second lock rod relative to the lock body is locked; and the first locking unit is displaced relative to the locking member in the X-axis direction to disengage the first locking unit from the second locking unit, so that the second lock rod returns to be rotatably arranged relative to the lock body; and the locking assembly further includes an auxiliary unlocking member which is provided with a first hook member, and the locking member is provided with a second hook member in fit with the first hook member; and when the locking member is displaced to an unlocked position, the first hook member fits with the second hook member to limit the locking member and keep the locking member at the unlocked position.

10. The cabinet safety lock according to claim 9, wherein the first hook member and the second hook member are also respectively provided with guide portions that fit with each other, so that the displacement of the locking member in the X-axis direction drives the auxiliary unlocking member to displace correspondingly, and hence the first hook member automatically cooperates with the second hook member; and the second lock rod is further provided with a top block, and the auxiliary unlocking member is provided with a top hole in fit with the top block; and when the lock rod is rotated for unlocking, the second lock rod is rotated to drive the auxiliary unlocking member to displace in the Y-axis or Z-axis direction, so that the first hook member is disengaged from the second hook member and the locking member is partially reset.

* * * * *